US005643416A

United States Patent [19]

Lange et al.

[11] Patent Number: 5,643,416

[45] Date of Patent: Jul. 1, 1997

[54] EXTENDED NIP PRESS WITH OSCILLATING BLANKET FOR EXTENDED WEAR

[75] Inventors: David V. Lange, Beloit, Wis.; David J. McCarville, Roscoe, Ill.; Jeffrey R. Garde, Orfordville, Wis.

[73] Assignee: Beloit Technologies, Inc., Wilmington, Del.

[21] Appl. No.: 659,815

[22] Filed: Jun. 7, 1996

[51] Int. Cl.[6] ..... D21F 3/08

[52] U.S. Cl. ..... 162/199; 162/256; 162/257; 162/272; 162/358.3

[58] Field of Search ..... 162/199, 272, 162/358.3, 361, 256, 257; 492/7

[56] References Cited

U.S. PATENT DOCUMENTS 3,184,374 5/1965 Pearson ..... 162/257

4,707,222 11/1987 Mullner ..... 162/358.3

5,084,137 1/1992 Ilmarinen et al. ..... 162/272

*Primary Examiner*—Karen M. Hastings

*Attorney, Agent, or Firm*—Dirk J. Veneman; Raymond W. Campbell; David J. Archer

[57] ABSTRACT

An Extended Nip-type press has a blanket which passes over a shoe which is urged against a backing roll to form a press nip. A hydraulic system and controller provides for automatic continuous oscillation of the blanket in the cross machine direction. The oscillation results in a region of high fatigue continuously moving over the blanket surface so that the amount of time any particular region sees wear is minimized. Positioning of the heads to which the blanket ends are mounted is controlled by hydraulic pistons mounted between a support beam and the heads. A controller operates a valve to reverse the direction of motion of the blanket when sensors indicate one end of the blanket has reached a stop. A throttle valve controls the rate at which hydraulic fluid is supplied to the cylinders which urge the head away from the shoe.

6 Claims, 3 Drawing Sheets

EXTENDED NIP PRESS WITH OSCILLATING BLANKET FOR EXTENDED WEAR

FIELD OF THE INVENTION

The present invention relates to presses used in papermaking machines in general and in particular to presses employing a shoe to form a nip with a backing roll in which the shoe is enclosed in a blanket and the blanket ends are closed by rotating heads.

BACKGROUND OF THE INVENTION

Significant advances in the design of papermaking machines have been made in the last twenty years. The direction of these improvements has been towards increased efficiency in the manufacture of paper by increasing the speed at which the web is formed and by increasing the width of the web. With increased machine speed the web being formed passes more quickly through each section of the papermaking machine.

The effectiveness of many operations, particularly drying and pressing, depend on the residence time of the web within a dryer or pressing nip. The greater speed of modern papermaking equipment means that individual components such as the presses must be made more effective. In the pressing section of a papermaking machine the effectiveness of the presses has been improved through the use of new technology presses. This is most effectively accomplished by utilizing a shoe with a concave surface opposite a backing roll. In order for the web to move through the nip without frictional resistance a blanket is passed over the shoe. The blanket is lubricated and cooled by a supply of oil or other lubricant which is forced between the blanket and the shoe.

One type of press utilizing a shoe is the so called open Extended Nip® press of the type manufactured by Beloit Corporation of Beloit, Wis. In this type of press, the lubricating blanket is supported on a plurality of support rolls which direct the blanket through the nip between the backing roll and the shoe in a way similar to the way in which conventional felts are directed.

In some circumstances open Extended Nip presses result in leakage of oil onto the felts and the web as they transit the nip. In other circumstances it is desirable to place the shoe above the backing roll. In this position the lubricating oil has a tendency to drain down onto the web being pressed. This has led to the development of the so called closed Extended Nip press. A closed Extended Nip press has a blanket the ends of which are extended beyond the nip and the shoe and sealed to a circular head. Sealing the ends of the blanket solves the problem of lubricant leakage. As the blanket moves through the nip it forms a cardioid shape as the circular blanket is deformed between the shoe and the backing roll. Thus the blanket transitions from a cardioid shape at the nip to the circular shape required by the mounting to the heads which contain the lubricant. The transition region of the blanket between the cardioid shape and the circular shape rotates as the blanket rotates through the nip. The repeated flexure of the blanket eventually causes the blanket material to fail. This failure of the blanket can be a significant source of maintenance down time, which, owing to the high capital investment in a papermaking machine, is a significant contributor to costs in the production of paper.

The motion of the blanket through a closed Extended Nip press results in a gradual lengthening of the blanket in the cross machine direction. In a typical Extended Nip press one head or end of the blanket is held fixed and the other is allowed to float. The free end is thus able to move laterally to accommodate the growth in the blanket. A gradual lengthening of the blanket takes place throughout the portion of the blanket which passes through the nip. Thus the end of the blanket which is held fixed experiences little or no lengthening, and the region of the blanket which is fatigued by the transition between the circular end heads and the cardioid shape remains fixed with respect to the blanket.

One approach to achieving a longer life of the closed nip blanket is to move the fixed side of the blanket by, for example, moving the position of the fixed side of the blanket. One known approach is to install spacers against a fixed stop thus moving the fixed end of the blanket so the fatigue-stressed region is shifted with respect to the fixed end. Thus existing methods rely on either a downtime adjustment or the machine operator to change the interface location of the blanket and the Extended Nip press shoe.

What is needed is a method and apparatus for extending the life of a blanket in an Extended Nip press.

SUMMARY OF THE INVENTION

The Press of this invention provides for automatic continuous oscillation of the Extended Nip press blanket in the cross machine direction. First one head is driven gradually by hydraulic pistons to shift the position of the blanket in one direction, and then the second head is driven gradually by hydraulic pistons to reverse the direction of motion of the blanket. The oscillation results in the region of high fatigue continuously moving over the blanket surface so that the amount of wear time any particular region sees is minimized. This maximizes the life of the blanket. The ends of the blanket are attached to circular back and front heads which are mounted for rotation on the ends or journals of a support beam. The support beam supports the shoe and the hydraulic piston which presses the shoe against the backing roll. The blanket extends past the ends of the shoe in the cross machine direction. The extensions of the blanket beyond the shoe are attached to the circular heads. The blanket takes on a cardioid shape as it moves through the nip. The transition from the nip-imposed cardioid shape to the circular shape maintained by the heads subjects a region of the blanket to fatigue. The heads are mounted on the journals for motion between inboard stops and outboard stops which are spaced apart approximately four inches in the cross machine direction. Positioning of the heads on the journals is controlled by four front hydraulic pistons mounted between the support beam and the front head and four back hydraulic pistons mounted between the support beam and the back head. The front pistons and back pistons are connected to a hydraulic system. The hydraulic system has a reservoir and a hydraulic pump which supplies hydraulic fluid to a supply line. A throttle valve mounted in the supply line controls the rate at which hydraulic fluid flows through the supply line. The hydraulic supply line is switched by a hydraulic switch between the front and the rear hydraulic cylinders. The hydraulic switch connects the hydraulic cylinders which are not being supplied with fluid to a hydraulic return line which flows back to the hydraulic reservoir. Sensors mounted on the hydraulic pistons determine the displacement of the front and rear heads. A controller operates the valve to reverse the direction of motion of the blanket when the sensors indicate one end of the blanket has reached a stop. The throttle valve controls the rate at which hydraulic fluid is supplied to the cylinders which urge the head connected to the hydraulic supply away from the shoe.

As the blanket passes through the nip formed by the shoe and the backing roll the blanket is repeatedly compressed in the nip. This compression results in a growth in the cross machine-direction length of the blanket. The motion of the heads on the journals provides room for the blanket to increase in length by about eight inches. The regions of the blanket subjected to fatigue are located a fixed distance from the ends of the shoes. The life of the blanket is maximized by continuously oscillating the blanket from side to side as it grows in length in the cross machine direction.

It is a feature of the present invention to provide a means for increasing the life of a blanket in a closed press employing a concave shoe and a backing roll.

It is another feature of the present invention to provide a press for a papermaking machine in which the press is of the type employing a concave shoe against a backing roll with lower maintenance requirements.

It is a further feature of the present invention to provide a method of operating a press for a papermaking machine of the type employing a concave shoe against a backing roll and using a blanket which is sealed, the method of operating expanding the life of the blanket.

Further objects, features and advantages of the invention will be apparent from the following detailed description when taken in conjunction with the accompanying drawings.

DESCRIPTION OF THE PREFERRED EMBODIMENT

Figure 1:
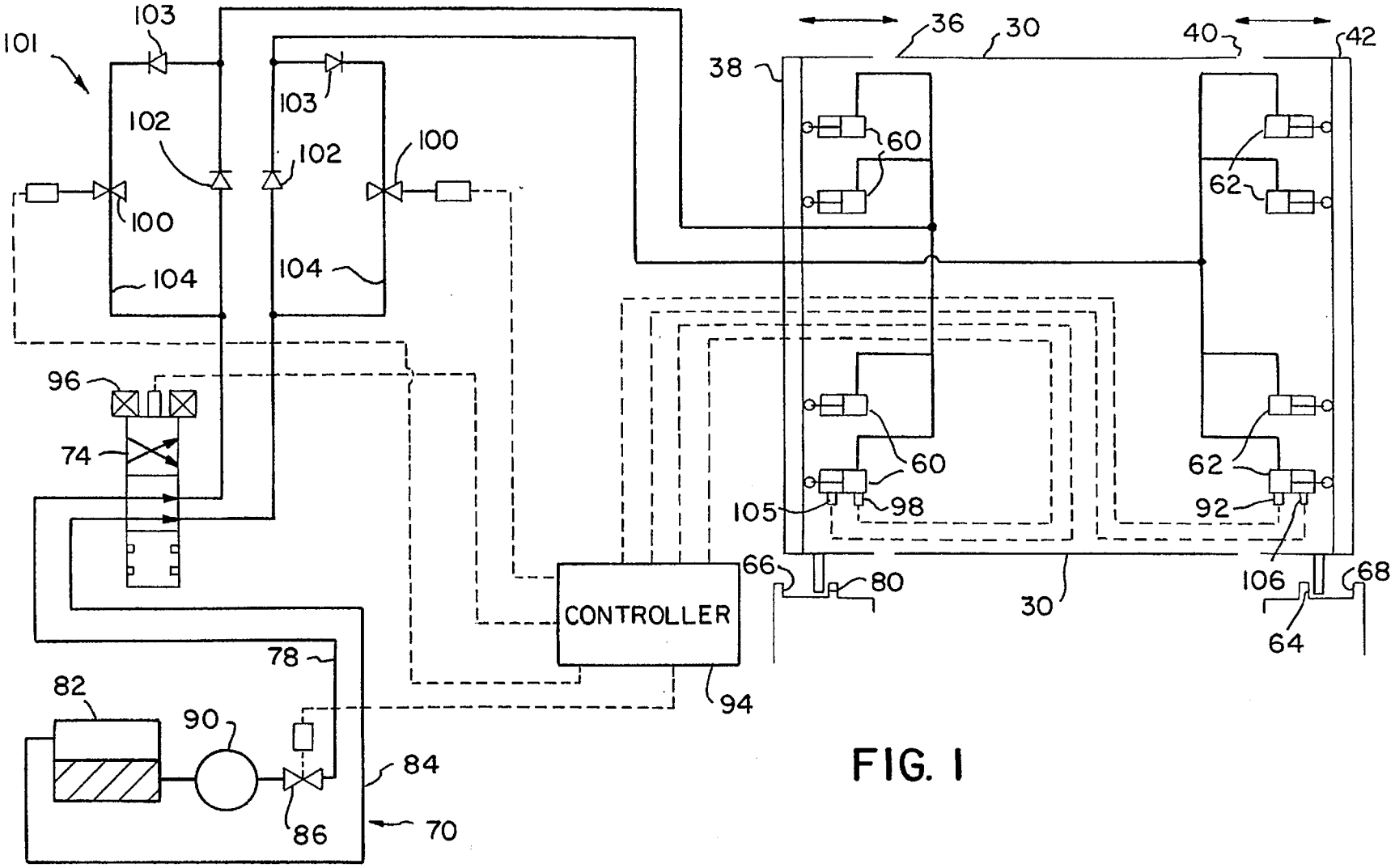
FIG. 1 is a schematic diagram of a press of this invention showing the hydraulic systems used for positioning a press blanket.
Figure 2:
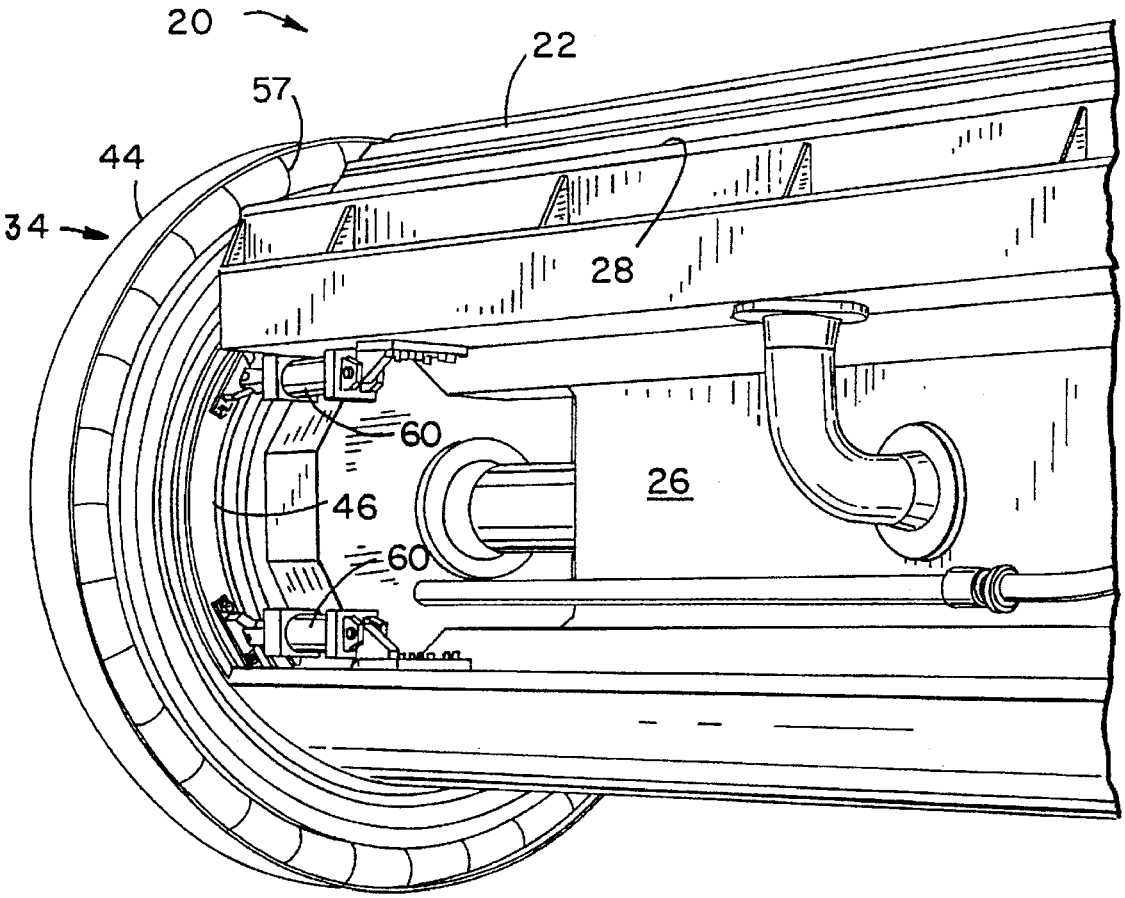
FIG. 2 is an isometric view of the press of FIG. 1.
Figure 3:
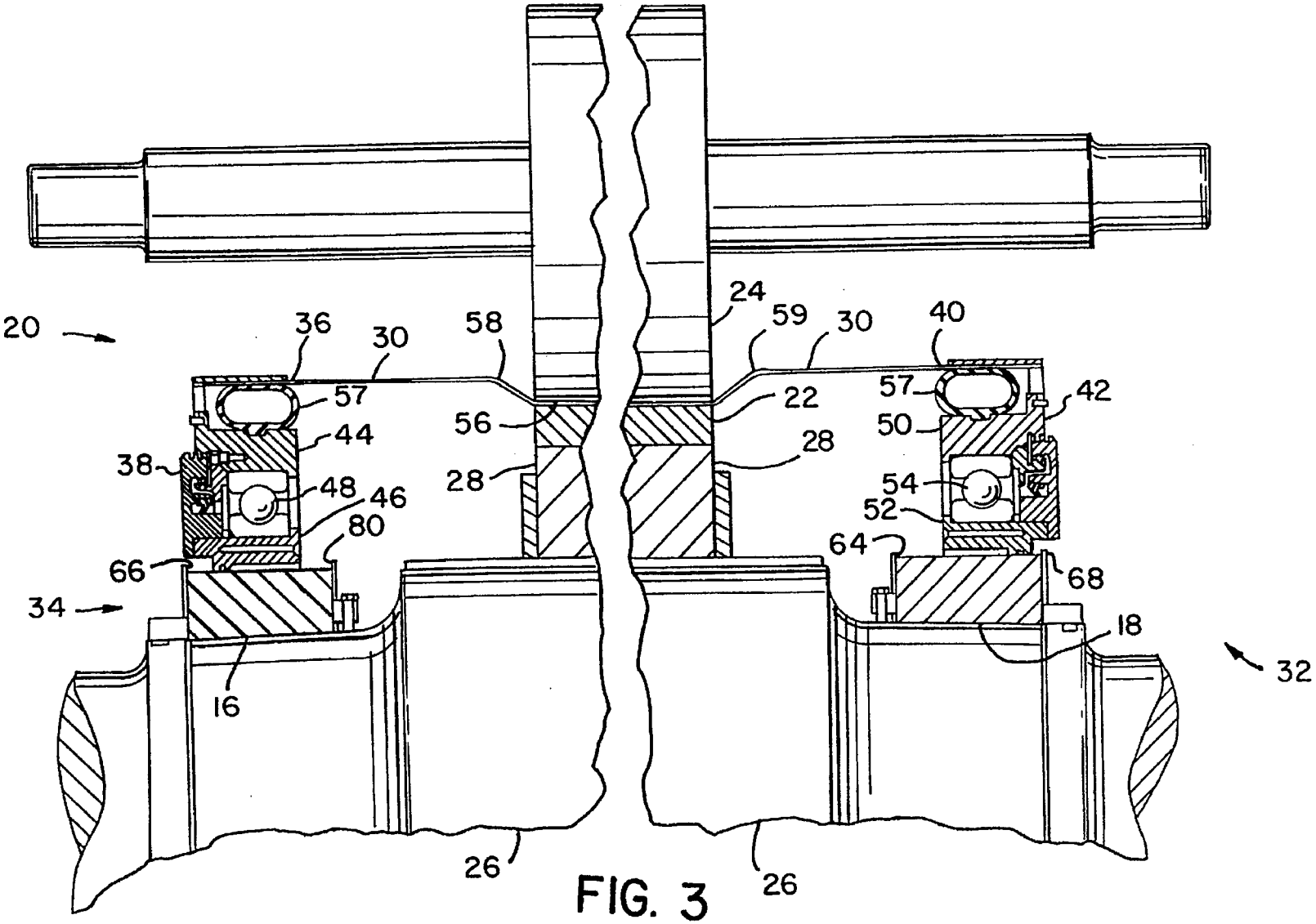
FIG. 3 is an elevational cross-sectional view of the press of FIG. 2.

Referring more particularly to FIGS. 1–3 wherein like numbers refer to similar parts, a press 20 formed by a shoe 22 and a backing roll 24 is shown in FIG. 3. The shoe 22 is supported on a cross beam 26 by one or more hydraulic pistons 28 which urge the shoe 22 against the backing roll 24. A film of oil or lubricating fluid is supplied between a blanket 30 and the shoe 22 allowing the blanket 30 to move over the shoe with low friction. The press 20 has a back end 32 and a front end 34. The blanket 30 front end 36 is mounted to a front head 38, and the blanket back end 40 is mounted to a back head 42. The front head 38 is divided into a front rotating portion 44 and a front sliding portion 46 which are joined by a bearing 48. The front head 38 is mounted by the sliding portion 46 to a front journal 16 which extends from the cross beam 26. The back head 42 is similarly divided into a rotating portion 50 and a back sliding portion 52 which are joined by a bearing 54. The back head 42 sliding portion 52 travels on the back journal 18 which extends from the cross beam 26.

In operation the blanket 30 rotates on the bearings 48, 54 so the blanket 30 passes through a nip 56 formed between the backing roll 24 and the shoe 22. The blanket moves at a velocity matching that of the roll 24 with which it is in contact. The blanket 30 is a flexible sheet and can easily be bent without deformation in a single plane. Stated another way, a flexible sheet can easily be bent in the shape of a conic-section or a series of conic-sections. Such shapes are also known as developable surfaces. The shape of the blanket 30 as it moves through the nip is somewhat cardioid in shape and this shape is developable. The cylindrical ends 36, 40 of the blanket 30 are clamped by toroidal bladders 57 to the heads 38, 42. The bladders 57 are sealed tubes connected to a source of air whereby they may be inflated to clamp the blanket, and deflated to release it. However, the transition between the cardioid shape and the clamped cylindrical ends 36, 40 of the blanket 30 causes bending in two planes simultaneously. These areas or regions 58, 59 of biplanar bending are subject to considerable deformation which results in a concentrated region of blanket fatigue. There are two highly fatigued areas on either side of the nip 56: a front region 58 and a back region 59. The regions 58, 59 are the portions of the blanket 30 in which blanket failure originates.

At the same time the blanket 30 is being fatigued it is also being subjected to squeezing as it passes through the nip 56. This squeezing or compression causes the blanket to grow in cross machine direction length. In existing machines one end-typically the back end-is held fixed and the front end is allowed to float free so the blanket can roll in the cross machine direction. In existing machines the fixed end has been moved periodically to reposition the regions 58, 59 subject to high fatigue. Repositioning one end spreads the fatiguing wear over a number of discrete locations. The optimal solution is to continuously move the blanket 30 in the cross machine direction so that any given part of the blanket adjacent to the ends 36, 40 experiences fatigue for only a short period of time.

As shown in FIG. 2, the position of the front head 38 is controlled by pistons 60 and the position of the back head 42 can be controlled by the pistons 62, indicated schematically in FIG. 1. Because the heads 38, 42 are connected by the blanket 30, only one set of pistons can control the position of the heads at any one time. As shown in FIG. 1, the hydraulic control system 70 has a hydraulic supply line 78 which is connected by a valve 74 to either the front pistons 60 or the rear pistons 62. The valve 74 is arranged so that the pistons which are not connected to the supply line 78 are connected to a return line 84. The hydraulic control system 70 has a hydraulic reservoir 82, a hydraulic pump 90, and a throttle valve 86. The pump 90 supplies hydraulic fluid from the reservoir 82 to the hydraulic cylinders which are moving the blanket 30. The throttle valve 86 controls the amount of hydraulic fluid supplied to the pistons 60 or 62 which are moving the blanket 30. Thus the throttle valve 86 controls the rate at which the blanket 30 moves.

If the front head 38 pistons are being supplied with hydraulic fluid as shown in FIG. 1, the front head moves towards the front outboard stop 66 as shown in FIG. 3. Hydraulic fluid is introduced at a selected rate, such that the head moves at a substantially constant rate, traversing the distance between the stops in a matter of hours or days. As shown in FIG. 1, position sensors 92 on the back head pistons 64 detect when the back head 42 is approaching within a predetermined distance of the back inboard stop 64. When this position is reached, the controller 94 activates the solenoid 96 on the valve 74, thereby connecting the supply line 78 to the back pistons 62 and causing the blanket to stop its movement toward the front outboard stop and instead move towards the back 32 of the press 20.

When the front head 38 approaches the front inboard stop 80 a front inboard sensor 98 mounted on the front pistons 60 signals the controller 94 which again activates the solenoid 96 to change the direction of cross-machine motion of the blanket 30.

When the blanket 30 is first placed on the press 20 both heads 38, 42 are positioned next to their inboard stops 80, 64 with perhaps only one inch of blanket length in which to oscillate back and fourth. Thus at first the blanket changes direction fairly frequently. However as the blanket 30 grows in length between the heads 38, 42 the path of the oscillating heads grows longer until the blanket 30 has grown long enough to reach the outboard stops 66, 68. At that point, outboard front head sensors 105 and outboard back head sensors 106 are used to control when the valve 74 is switched to reverse the direction of motion of the blanket 30.

The blanket shown in FIG. 3 has four inches of travel between inboard stops 80, 64 and outboard stops 66, 68. As the blanket 30 grows beyond four inches long space available for oscillation decreases until the blanket has grown by about seven inches and the blanket again has only one inch in which to oscillate. When the blanket 30 has run out of room to oscillate the press 20 is shut down and the blanket is trimmed by about six inches and the process of oscillating the blanket back and forth between the backing roll 24 and the shoe 22 is started over again.

The blanket 30 must be kept under tension at all times for the blanket to remain stable. Air pressure within the blanket can supply the necessary tension—typically one-half to two psi. of air pressure is used. The fact that the blanket 30 is in constant motion tends to keep slack from developing in the blanket 30. If additional tension is required the return line 84 can be passed through a throttle valve 100 which, by controlling the rate at which hydraulic fluid is allowed to drain from the non-driven pistons, can control the tension produced between the front and back heads. In order to have the throttle control valves 100 only in the return line a series of check valves 102, 103 together with bypass lines 104 are used so the hydraulic fluid only flows through the throttle valve 100 when it is flowing towards the reservoir 82.

The hydraulic valve system 101 has a first check valve 102 positioned to allow hydraulic fluid to flow only towards the first and second hydraulic pistons 60, 62. Bypass return lines 104 bypass the first check valves 102, but have second check valves 103 positioned in the bypass return lines 104 to allow hydraulic fluid to flow only towards the hydraulic reservoir 82. The throttle valves 100 are positioned in the return bypass lines 102 to control tension in the blanket.

In an existing press employing a blanket, the blanket might be repositioned by 0.66 inches every fourteen days. This means that about 14 percent of the total wear occurred at each discrete location. By continuous oscillation of the blanket the amount of wear at any discrete location is reduced to less than 1½ percent of the total wear.

It should be understood that the rate at which the blanket oscillates depends on the rate at which hydraulic fluid is supplied to the driving pistons—either the front pistons 60 or the rear pistons 62. The rate of oscillation preferably will result in the blanket completing one cycle in a matter of hours to days. The rate at which hydraulic fluid is supplied to the driving pistons is controlled by the throttle valve 86 which can be manually adjusted or could be adjusted through the controller 94 according to a preprogrammed schedule or through an operator selected rate. In a similar way the throttle valves 100 could be adjusted manually or by the controller 94 to control the amount of tension in the blanket.

It is understood that the invention is not limited to the particular construction and arrangement of parts herein illustrated and described, but embraces such modified forms thereof as come within the scope of the following claims.

We claim:

1. A press in a pressing section of a papermaking machine comprising:

a closed blanket extending in the cross machine direction and forming an endless loop in the machine direction;

a stationary support beam extending through the looped blanket in the cross machine direction, wherein the support beam has a first journal and a second journal spaced in the cross machine direction from the first journal;

at least one press shoe mounted on the support beam and extending in the cross machine direction within the looped blanket;

a backing roll positioned in spaced parallel relation to the blanket and the shoe to form a nip with the shoe, wherein the shoe has a concave surface opposite the backing roll, the concave surface and the backing roll forming a nip which extends in the machine direction;

a first head mounted on the first journal for rotation about the support beam, said first head being mounted to the first journal for translation motion in the cross machine direction, wherein the blanket has a first end which is clamped to the first head;

a second head mounted on the second journal for rotation, said second head being mounted for translation motion in the cross machine direction, wherein a second end of the blanket is clamped to the second head;

at least one first hydraulic piston positioned between the support beam and the first head for applying force in a cross machine direction;

at least one second hydraulic piston positioned between the support beam and the second head for applying force in a cross machine direction;

a hydraulic system for supplying hydraulic fluid at a selected rate, the hydraulic system having a supply line and a return line;

a valve for switching the supply line and the return line from a first state in which the hydraulic system supplies hydraulic fluid to the first piston and fluid is returned from the second piston, and a second state in which the hydraulic system supplies hydraulic fluid to the second piston and fluid is returned from the first piston, and structured and arranged to thereby selectably move the blanket in an oscillating back and forth motion in the cross machine direction.

2. The apparatus of claim 1 further comprising:

at least one first sensor mounted to detect displacement of the first head;

at least one second sensor mounted to detect displacement of the second head; and a controller which receives signals from the first and second sensors, wherein the controller switches the valve to alternatively direct hydraulic fluid to the first piston, and then the second piston, to thereby repeatedly reverse the travel of the blanket and cause it to oscillate beneath the nip.

3. The apparatus of claim I further comprising a hydraulic throttle valve connected in the hydraulic systems and operable to adjust the amount of hydraulic fluid supplied to the supply line.

4. The apparatus of claim I further comprising hydraulic valve systems connected one in a hydraulic fluid line leading to the first hydraulic piston and another in a hydraulic fluid line leading to the second hydraulic piston after the valve for switching; wherein each hydraulic valve system comprises:

a first check valve positioned to allow hydraulic fluid to flow only toward the hydraulic piston;

a bypass return line which bypasses the first check valve;

a second check valve positioned in the bypass return line to allow hydraulic fluid to flow only away from the hydraulic piston; and a throttle valve positioned in the return bypass line to control tension in the blanket.

5. The apparatus of claim 1 further comprising:

a first inboard stop mounted on the first journal for limiting the motion of the first head towards the shoe;

a first outboard stop mounted on the first journal for limiting the motion of the first head away from the shoe;

a second inboard stop mounted on the second journal for limiting the motion of the second head towards the shoe; and a second outboard stop mounted on the second journal for limiting the motion of the second head away from the shoe.

6. A method of increasing the life of a closed type blanket employed in a press of the type having a backing roll and a shoe with a concave surface which is urged against the backing roll, wherein first and second ends of the blanket are sealed to first and second heads and wherein the press has a first inboard stop and a first outboard stop for positioning the first head, the press also having a second inboard stop and a second outboard stop for positioning the second head; the method comprising the steps of:

positioning the blanket between the first head and the second head so the combined distance between the first head and the first inboard stop and the distance between the second head and the second inboard stop is about one inch;

alternately connecting a hydraulic supply system to hydraulic pistons to move the blanket towards the first head, followed by motion towards the second head;

controlling the motion of the blanket so when the direction of travel is towards the first head, the direction of motion is reversed when the second head approaches the second inboard stop;

controlling the motion of the blanket so that when the direction of travel is towards the second head the direction of motion is reversed when the first head approaches the first inboard stop;

continuing the two previous steps until the blanket has increased in cross machine direction length such that when the direction of travel is towards the first head the first head approaches the first outboard stop before the second head approaches the second inboard stop, and afterwards controlling the motion of the blanket so that when the direction of travel is towards the first head the direction of motion is reversed when the first head approaches the first outboard stop, and when the direction of travel is towards the second head the direction of motion is reversed when the second head approaches the second outboard stop; and trimming the cross machine width of the blanket when the blanket has increased in cross machine direction length so that the first head and the second head are a total distance from the first inboard stop and the second inboard stop respectively of about one inch.

* * * * *